US005741028A

United States Patent [19]

Hatano et al.

[11] Patent Number: 5,741,028

[45] Date of Patent: Apr. 21, 1998

[54] FOLDER

[76] Inventors: Nobuaki Hatano, 9 Pinewood Cir., Wellesely, Mass. 02181; Hsieh Feng-Chuan, 11F-2, No. 378, Sec. 1 Weh Hsin Rd., Taichung, Taiwan

[21] Appl. No.: 805,771

[22] Filed: Feb. 25, 1997

[51] Int. Cl.[6] ..... B42D 3/00

[52] U.S. Cl. ..... 281/45; 229/67.1; 281/15.1; 402/73

[58] Field of Search ..... 281/15.1, 45, 51, 281/38; 402/73, 70, 79; 229/67.1, 67.4; 206/425

[56] References Cited

U.S. PATENT DOCUMENTS

| | | | |
|---|---|---|---|
| 2,333,798 | 11/1943 | Kner | 229/67.4 |
| 4,749,121 | 6/1988 | Barber et al. | 402/79 |
| 4,790,474 | 12/1988 | Mitsuyama | 402/79 |
| 4,871,066 | 10/1989 | LaWall | 206/425 |
| 4,988,038 | 1/1991 | Mitsuyama | 281/31 |
| 5,193,681 | 3/1993 | Lievsay | 206/425 |

*Primary Examiner*—Willmon Fridie, Jr.
*Attorney, Agent, or Firm*—Charles E. Baxley, Esq.

[57] ABSTRACT

A folder includes a body with a front wall, a rear wall, two side walls connected between the front wall and the rear wall and a bottom wherein a plurality of envelopes are disposed in the body and a cover extends from the rear wall. A stand device includes a first plate and a second plate which is connected to a lower edge of the rear wall and the first plate foldably extending from the second plate with a free end of the first plate fixedly connected to the rear wall so that the folder stands on a plan surface by stretching the second plate. The envelopes overlap with each other and are connected in series.

3 Claims, 5 Drawing Sheets

FOLDER

BACKGROUND OF THE INVENTION

1. Field of the Invention

The present invention relates to a folder and, more particularly, to an improved folder which can be stand on a table and has a plurality of envelopes disposed in the folder for objects such as documents to be received therein.

2. Brief Description of the Prior Art

Folders are used widely in offices or business operations. Generally, a folder is made of plastic material and has a rear plate and a front plate which is usually made of transparent material and is connected to the rear plate with three sides thereof to form an open side between the front plate and the rear plate so as to receive papers or documents therein. Folders usually are put in a drawer one by one to form a row of folders, therefore, when a user wants to find a document received in one of the row of folders, he/she must pull the drawer out and find the folder he/she needs row by checking the folders one by one, although the front plate of the folder is transparent. Such an action to find a folder and to return the folder in the drawer takes a lot of time. Furthermore, the front plate and the rear plate of the folder closely abut with each other when not used, thus the user then has to separate the front and the rear plates then he/she can put a document in the folder or pick a document out from the folder, and this takes time too. If documents or drawings received in the folders are to be displayed in front customers, the displayer will need a proper display device to show them conveniently on the table.

The present invention intends to provide an improved folder which has a plurality of envelopes disposed therein and is able to stand on a table so that the above-mentioned problems can be mitigated and/or obviated.

SUMMARY OF THE INVENTION

The present invention provides a folder comprising a body having a front wall, a rear wall, two side walls connected to the front wall and the rear wall, and a bottom. A cover extending from an upper edge of the rear wall.

A stand device includes a first plate and a second plate which is foldably connected to a lower edge of the rear wall and the first plate foldably extending from the second plate with a free end of the first plate connected to the rear wall near the upper edge of the rear wall.

A plurality of envelopes overlapping with each other in series are disposed in the body. Each of the envelopes has a front plate and a rear plate which is fixedly connected to the front plate along three of four sides of the front plate. Each of the rear plates has a tongue foldably and rearwardly extending therefrom and the first envelope is connected to the bottom of the body. Each of the tongues except that of the last envelope is fixedly connected to a following envelope's front plate which faces to the tongue.

It is an object of the present invention to provide a folder which can stand on a plan surface.

It is another object of the present invention to provide a folder which has a plurality of envelopes disposed therein and the envelopes are connected with each other in series.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
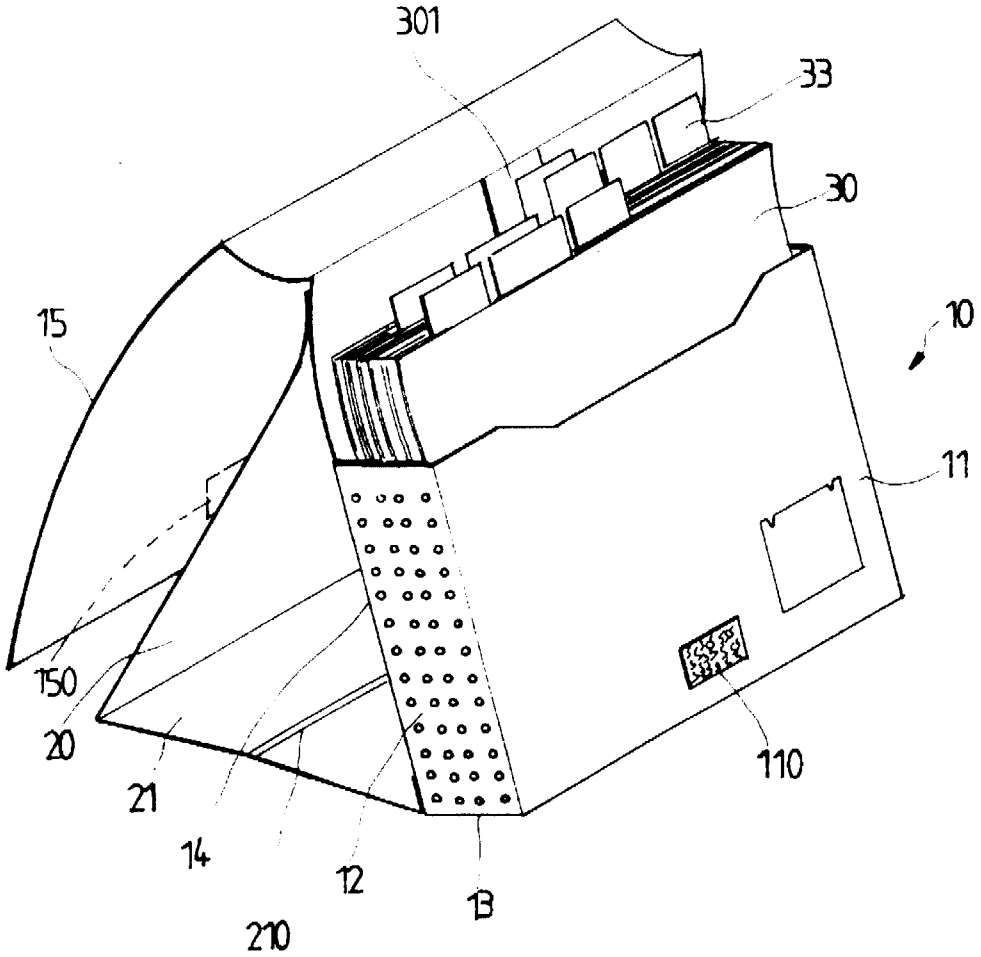
FIG. 1 is a perspective view of a folder ready to be used in accordance with the present invention.
Figure 2:
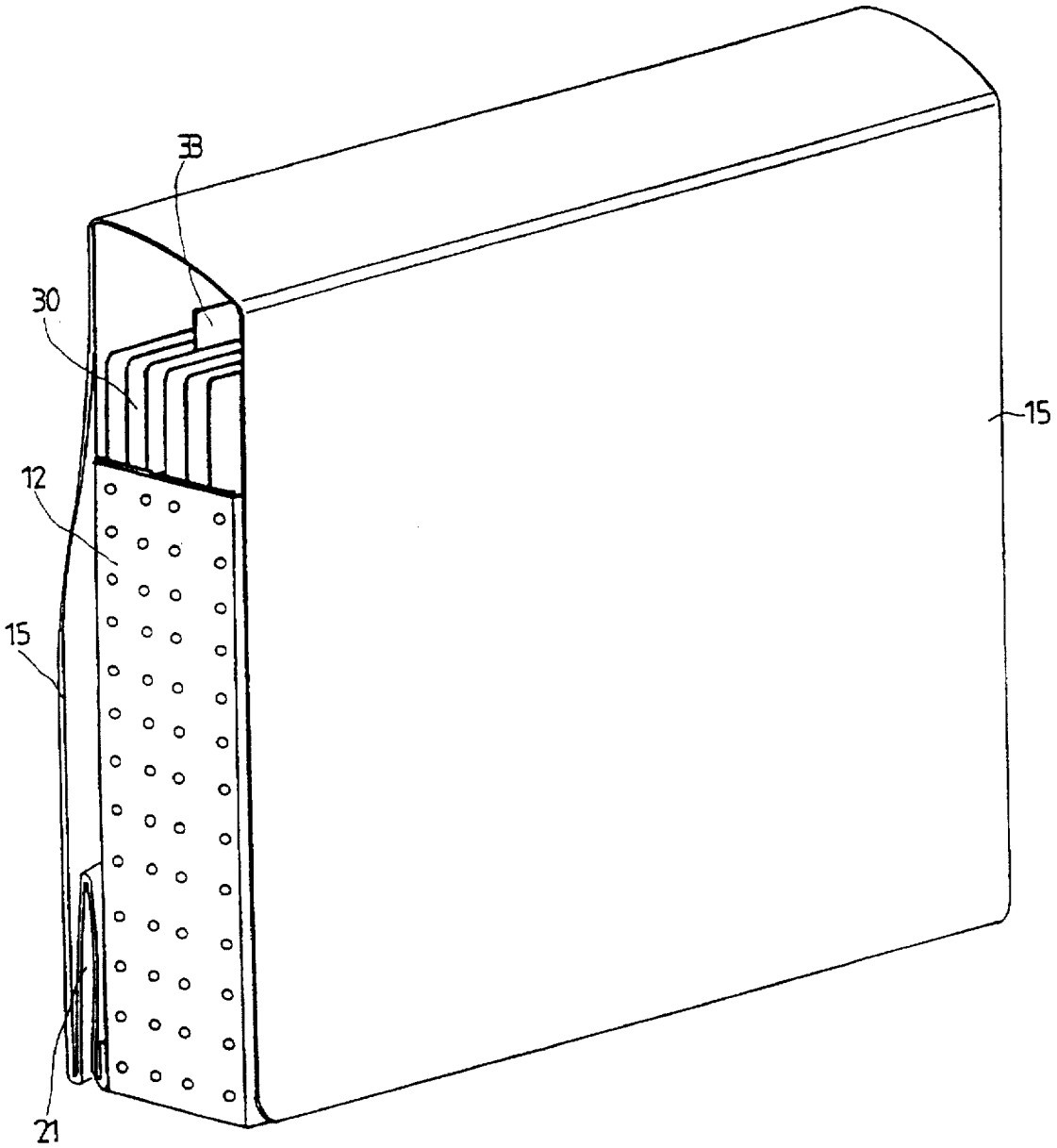
FIG. 2 is a perspective view of a folder when a cover thereof is attached to a front wall of the folder in accordance with the present invention.
Figure 3:
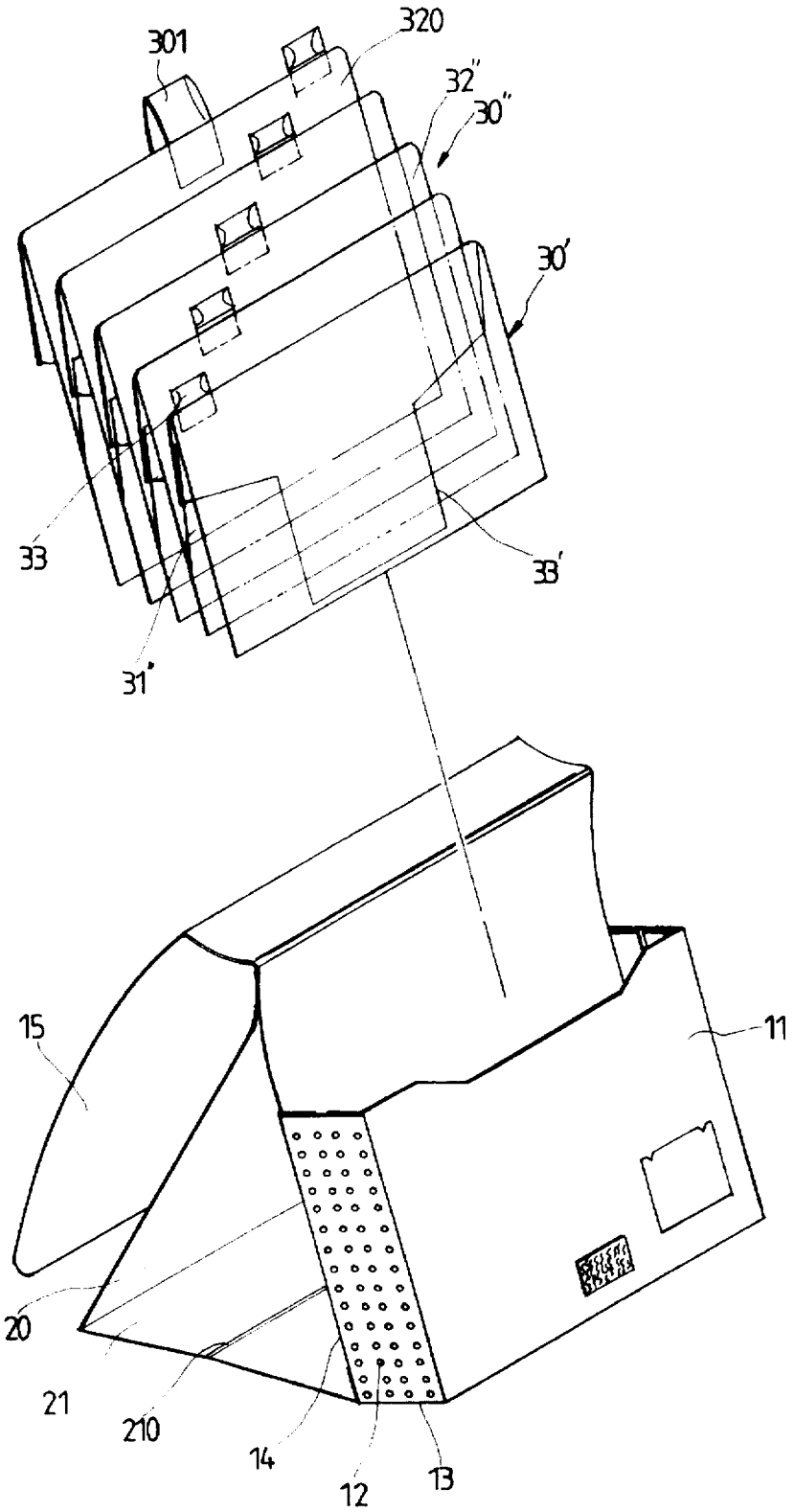
FIG. 3 is an exploded view of the folder and a plurality of envelopes which are to be disposed in the folder in accordance with the present invention.

Referring to the drawings and initially to FIGS. 1 through 3, a folder in accordance with the present invention generally includes a body 10 having a front wall 11, two side walls 12 respectively extending from two opposite sides of the front wall 11, a bottom 13 and a rear wall 14 connected between the two side walls 12. A cover 15 foldably extends from an upper edge of the rear wall 14, each of the cover 15 and the front wall 11 having a fabric fastener 110/150 disposed thereto so that the cover 15 may covers on the front wall 11 by attaching the two fasteners 110/120 together when not used as shown in FIG. 2.

A stand device includes a first plate 20 and a second plate 21 which is foldably connected to a lower edge of the rear wall 14 and the first plate 20 foldably extends from the second plate 21. The first plate 20 has a free end fixedly connected to the rear wall 14 near the upper edge of the rear wall 14 so that when the second plate 21 is stretched horizontally, the body 10 can be supported by the first plate 20 and the folder stands on a plan surface, such as on a table (not shown). A folding line 210 is defined longitudinally on the second plate 21 so that when the folder is not used, the first plate 20 contacts the rear wall 14 with the second plate 21 being folded along the folding line 210 as shown in FIG. 2.

Figure 4:
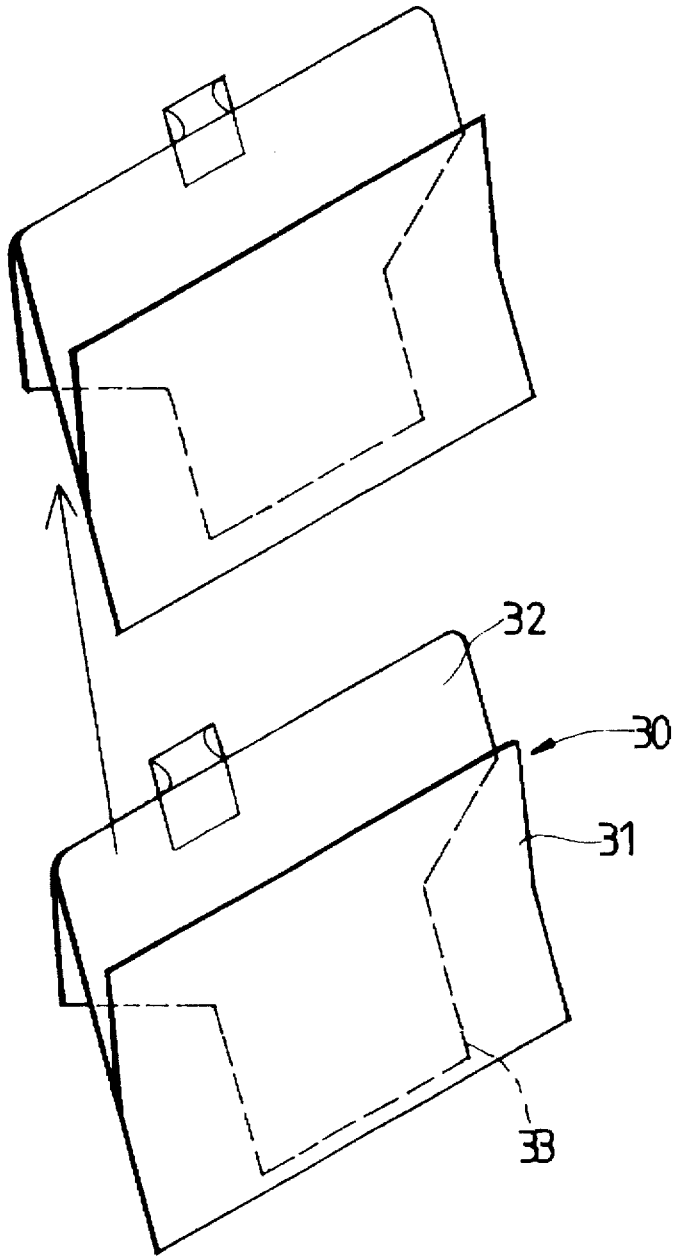
FIG. 4 is an exploded view of two of the envelopes.

Further referring to FIG. 4, a plurality of envelopes 30 are disposed in the body 10 and each of the envelopes 30 has a front plate 31 and a rear plate 32 which is fixedly connected to the front plate 31 along three of four sides of the front plate 31 wherein a top of the rear plate 32 extends higher than a top of the front plate 31. Each of the rear plates 32 has a tongue 33 foldably and rearwardly extending from the top thereof. Further referring to FIG. 4, the envelopes 30 overlap with each other in series wherein the first envelope 30' is fixedly connected to the bottom of the body 10. Each of the tongues 33 except that of the last envelope is inserted between the front plate 31" and the rear plate 32" of the following envelope 30" which faces to the tongue 33' of the first envelop 30'. The tongue 33' is then fixedly connected to an interior of the front plate 31" of the following envelop 30". The rear plate 320 of the last envelope 30 has a tab 301 fixedly disposed to a top thereof and each of the rear plates 32 of the envelopes 30 has an extending portion 33 extending from the sop thereof for an index (not shown) to be received therein.

Figure 5:
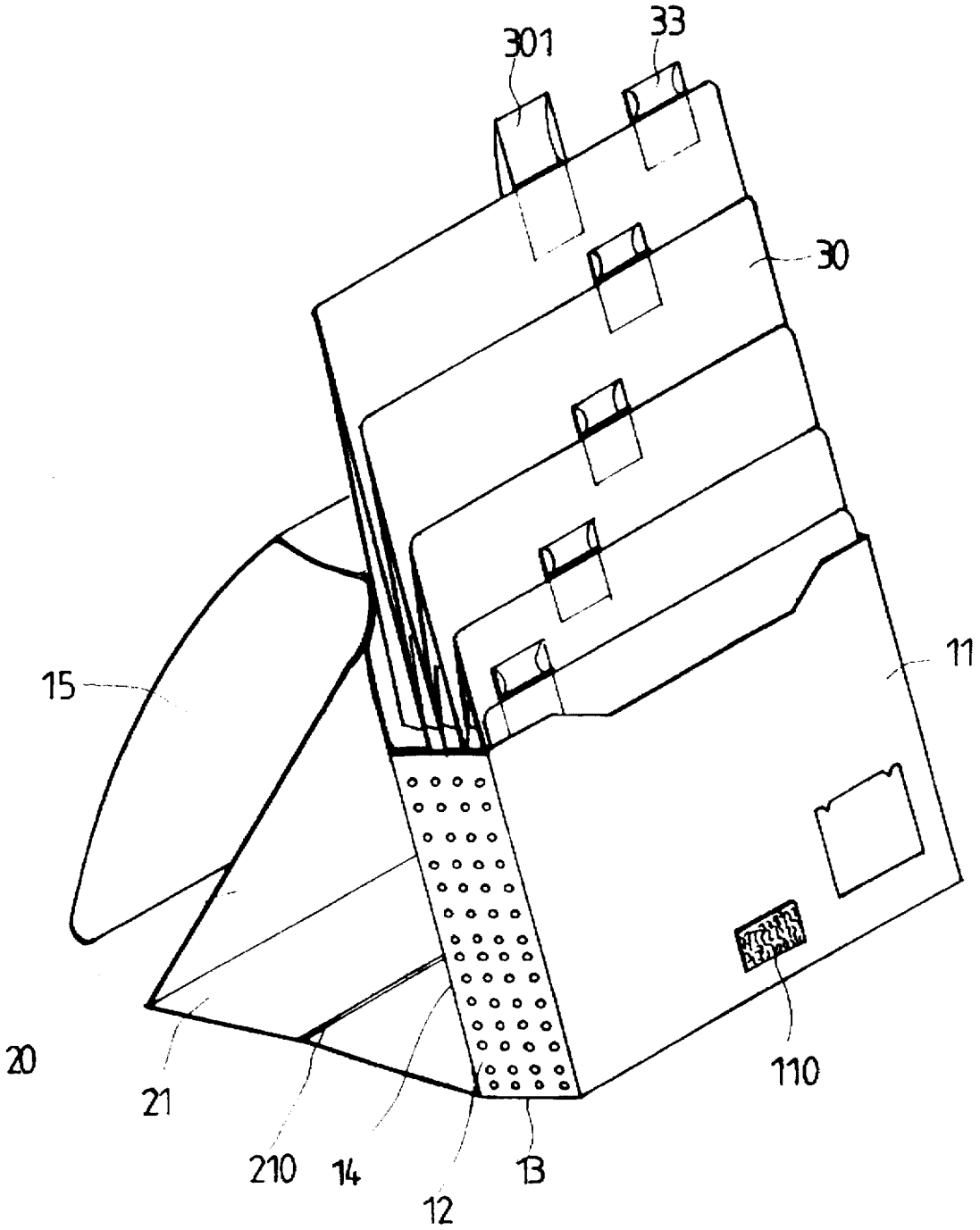
FIG. 5 is a perspective view of the folder ready to be used wherein the envelopes are pulled from the folder.

Accordingly, referring to FIG. 5, when pulling the tab 301 on the last envelop 30, a series of the envelopes 30 can be pulled from the body 10 with out departing from the body 10.

Although the invention has been explained in relation to its preferred embodiment, it is to be understood that many other possible modifications and variations can be made without departing from the spirit and scope of the invention as hereinafter claimed.

What is claimed is:

1. A folder comprising:

a body having a front wall, two side walls respectively extending from two opposite sides of said front wall, a bottom and a rear wall connected between said two side walls, a cover extending from an upper edge of said rear wall;

a stand device including a first plate and a second plate which is foldably connected to a lower edge of said rear wall and said first plate foldably extending from said second plate, said first plate having a free end fixedly connected to said rear wall near said upper edge of said rear wall, and a plurality of envelopes disposed in said body, each of said envelopes having a front plate and a rear plate which is fixedly connected to said front plate along three of four sides of said front plate, each of said rear plates having a tongue foldably and rearwardly extending therefrom, said envelopes overlapping with each other in series wherein the first envelope is connected to said bottom of said body, each of said tongues except that of the last envelope being fixedly connected to a following envelope's front plate which faces to said tongue in front thereof.

2. The folder as claimed in claim 1 wherein each of said rear plates has an extending portion extending therefrom for an index to be received therein.

3. The folder as claimed in claim 1 wherein said rear plate of said last envelope has a tab fixedly disposed thereto.

* * * * *